US006135659A

United States Patent [19]

Ku

[11] Patent Number: 6,135,659

[45] Date of Patent: Oct. 24, 2000

[54] WIDE FACED APPLICATOR ADAPTED TO VARIOUS KINDS OF FLUID

[76] Inventor: Tro-Kung Ku, 4th Fl., No. 36, Lane 333, Chien Kan Rd., Sec. 1, Tainan City, Taiwan

[21] Appl. No.: 09/209,411

[22] Filed: Dec. 10, 1998

[51] Int. Cl.[7] ..... B43K 5/06; B43M 11/06; A46B 11/02; B05C 11/02

[52] U.S. Cl. ..... 401/4; 401/148; 401/180; 401/193; 401/206; 401/264; 401/266; 401/272

[58] Field of Search ..... 401/4, 103, 148, 401/180, 193, 206, 266, 273, 272, 260, 176, 264

[56] References Cited

U.S. PATENT DOCUMENTS

| | | | |
|---|---|---|---|
| 775,411 | 11/1904 | Wheeler | 401/206 |
| 2,996,750 | 8/1961 | Cholet | 401/206 |
| 4,685,820 | 8/1987 | Kremer et al. | 401/206 X |
| 4,976,564 | 12/1990 | Fukuoka et al. | 401/206 |
| 5,035,524 | 7/1991 | Sakurai | 401/206 |
| 5,727,893 | 3/1998 | Handler | 401/266 X |
| 5,938,360 | 8/1999 | Yen et al. | 401/206 |

FOREIGN PATENT DOCUMENTS

| | | | |
|---|---|---|---|
| 2189689 | 11/1987 | United Kingdom | 401/206 |

*Primary Examiner*—Henry J. Recla
*Assistant Examiner*—Kathleen J. Prunner
*Attorney, Agent, or Firm*—Bucknam and Archer

[57] ABSTRACT

A wide faced applicator adapted for various kinds of fluids having a main body with a flat face on both sides of the front axis to form a narrow attachment face, the axis of the main body from top to bottom forms a multiple funnel shaped axial hole in which a pin shaped core body is inserted, the core body is spring biased so that the shoulder portion on the front end of the core body contacts tightly against the funnel shaped axial hole on the front axial end of the main body to form a closed position. A guiding orifice is provided on the wide attachment face at the front end of the closed segment. By pressing the front end of the core body, the fluid in the container tank is released to flow through a guiding orifice and further permeate into the attachment face. The front end of the pin shaped core body forms a plane with rounded angles. The width of the guiding orifice is smaller than or equal to the axial width of the front end of the core body such that the section of the front end thereof covers the laminated faces of the guiding orifice and there is no visible gap between the two. During application, the notch portion of the guiding orifice is flattened by the top end of the core body so that a flat and even application face is formed.

38 Claims, 14 Drawing Sheets

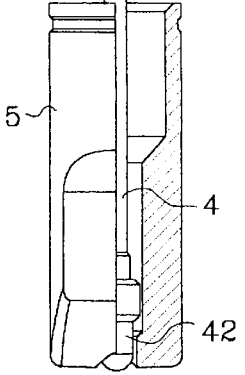
FIG. 2-1C
(PRIOR ART)
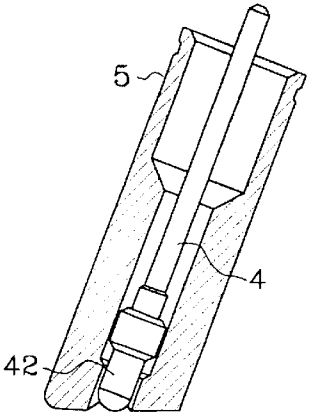
FIG. 2-2C
(PRIOR ART)
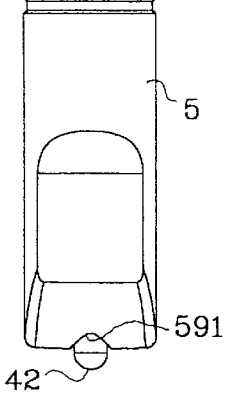
FIG. 2-1B
(PRIOR ART)
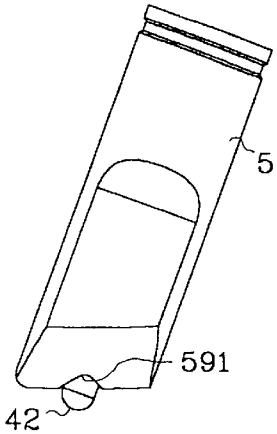
FIG. 2-2B
(PRIOR ART)
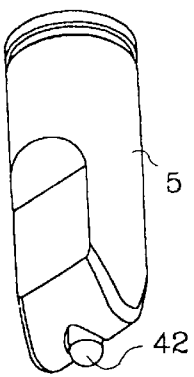
FIG. 2-1A
(PRIOR ART)
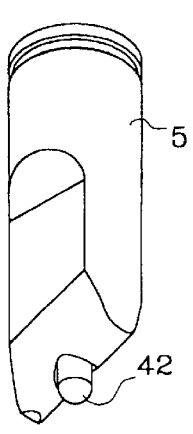
FIG. 2-2A
(PRIOR ART)
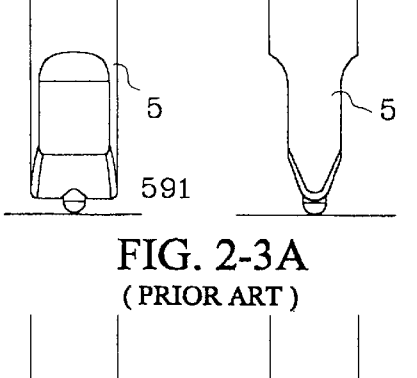
FIG. 2-3A
(PRIOR ART)
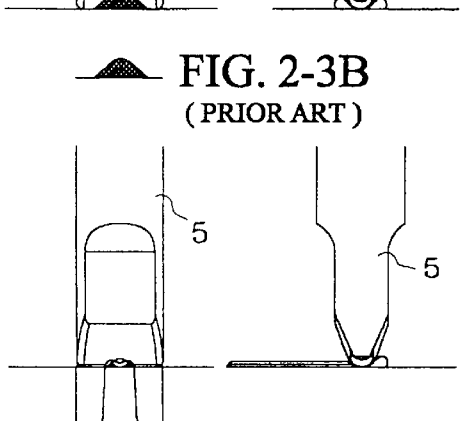
FIG. 2-3B
(PRIOR ART)
FIG. 2-3C
(PRIOR ART)

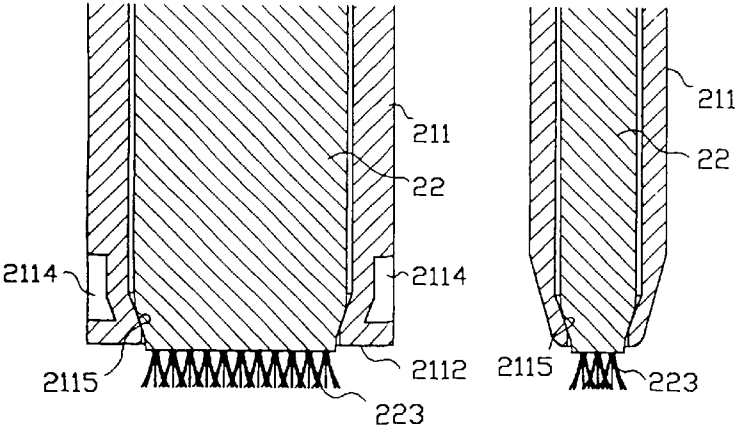
FIG. 10-1A
FIG. 10-1B
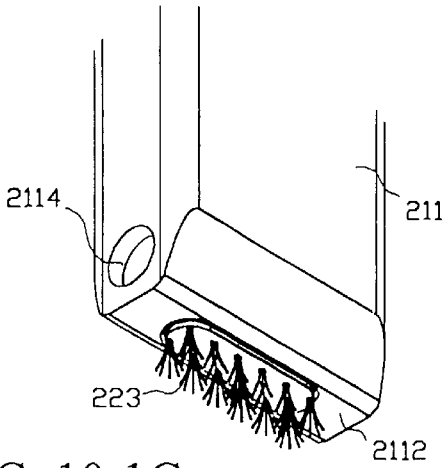
FIG. 10-1C
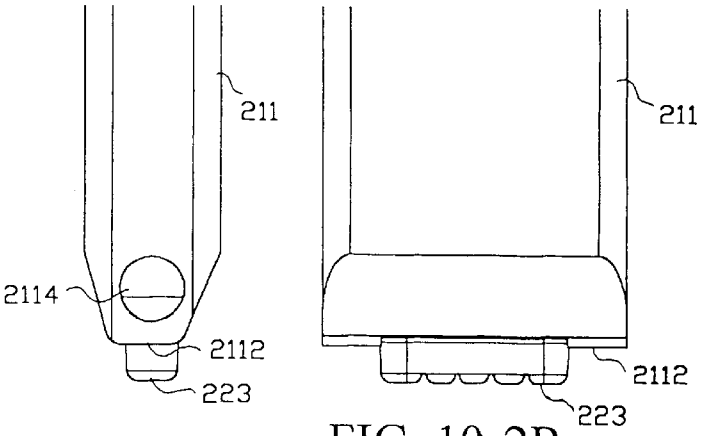
FIG. 10-2A
FIG. 10-2B
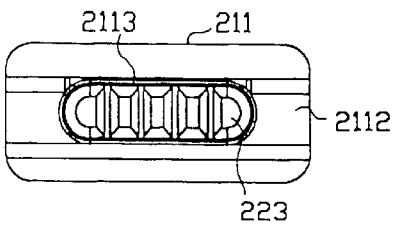
FIG. 10-2C
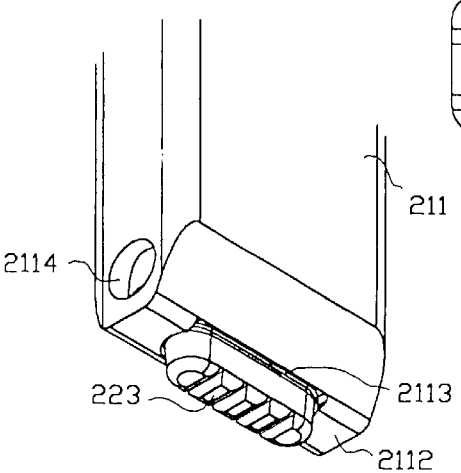
FIG. 10-2D (C-C)

(D-D)

(C-C)

WIDE FACED APPLICATOR ADAPTED TO VARIOUS KINDS OF FLUID

FIELD OF THE INVENTION

The present invention is related to a wide faced applicator adapted to various fluids, particularly to a novel design wherein the notch width of a guiding orifice on the wide side of the attachment face in the applicator is less than or equal to the axial width of the front end of the pin shaped core, the cross section of which covers the guiding orifice, thereby forming a flat and uniform application surface.

DISCLOSURE OF THE PRIOR ART

Japanese Utility Model Kai Hei No. 5-31996 published on Apr. 27, 1993 entitled a "Fluid Applicator" discloses a conventional wide faced applicator as shown in FIGS. 1A to 1E. It discloses an applicator capable of adapting to two different widths for wide and narrow, and its related design, such as both sides slanting surfaces and slanting angle of application face, a pin shaped structure inside, etc. In this technique, as there is no proper design for a notch for guiding fluid flow in a container 5 so as to forcibly guide the fluid in the container 5 to a tip 7 or the outside to insure a stable application, the effect is therefore not good.

In addition, FIGS. 2-1 to 2-6 show the device of Taiwanese Patent Publication No. 325008 published in Jan. 11, 1998, entitled as "A New Structure of Stationery Having Pin Shaped Construction with Different Wide Areas". The aim of this patent is to improve the defects of the above Japanese patent. As shown in FIGS. 2-1 and 2-2, a semicircular notch 591 is formed on both sides of the axial hole of the wide face in the contacting portion. During use, a pin shaped end 42 is pressed for the fluid in the container to be effectively guided to the contacting portion, thereby proceeding the need of adjustment of the wide area. However, some drawbacks are found in the course of actual practice as follows:

1) Referring to FIG. 2-3, at least 0.2 to 0.5 seconds are required before an applicator of this type commences application. First, a pin shaped head portion tops the application surface such as paper sheet, etc. for the fluid in the container to flow outward to both sides of the pin shaped head portion. Due to the notch of the guiding orifice 591 having a semicircular shape, the fluid flowing out will form into a drop in front of the semicircular orifice on both sides of the pin shaped head portion (see FIG. B). Adjacent to the starting point, the application is extraordinary wide and thick (see FIG. C), as a result of the thick application the diluent and solvent are difficult to completely volatilize. Therefore, after application, the drying speed of the fluid will slow down and the applied fluid will become uneven. The subsequent application operation will be difficult to proceed thereafter.

2) An analysis of the dried film after completion of application shows that the section of the film as shown in FIG. 2-4 has two thicker and slightly projected patterns due to the semicircular section of the pin shaped head portion and the excessive curvature. As the notch of the guiding orifice is semicircular and the width thereof is greater than the diameter of the pin shaped head portion, when viewed from the side, a notch is clearly visible on both sides of their laminated faces. Therefore, during application, the fluid in the container flows outward through these two orifices without being subjected to a proper application through a curved opening on top of the pin shaped head portion.

3) To put various kinds of fluid having different viscosity in the container of the applicator, such as a high viscosity adhesive, the applicator cannot be used as illustrated in FIG. 2 analyzing the actual cause, it is noted that in the vertical segment of the main body 5 from the front end of the closed front portion 51 to contact portion 55, the pin shaped head end and the axial hole 54' will seriously clog. Therefore, the pin shaped structure does not adapt to fluid of high viscosity.

4) Referring to FIG. 2-6, to use again after long-term storage, the fluid under long-term state of repose will produce precipitates. Particularly in the course of using this creation, the inlet on the inward end of the pin shaped structure 4 has the configuration that one end of the pin shaped structure 4 passes through an extremely small circular hole on the tip end of the conical hole 26 of the seat 2, as a result of which the precipitates of the fluid easily to block the hole. Therefore, such structure is only adapted to fluid of low viscosity which do not produce precipitates, and it is impossible to use for fluids of various viscosity or fluid which easily solidifies.

SUMMARY OF THE INVENTION

In view of the drawback of the conventional applicator which requires the use of a thread to apply the wide area to and fro and wherein the operation is not stable or the application quality inferior, a wide faced applicator is therefore provided which is adapted to various kinds of fluid such as correction liquid, ink, adhesive, paint, wax, etc.

A primary object of this invention is to provide an applicator comprising a container tank body, a main body, a seat and a cover. The main body has a flat face on both sides of the front axis to form a narrow attachment face. The axis of the main body from top to bottom forms a multiple funnel shaped axial hole in which a pin shaped core body is inserted. A spring is engaged with the rear edge of the core body. An end stopper contacts tightly against one end of the spring with an inner radial hole loosely engaged with the axial end of the core body, and an outer edge inserted in the axial end of the main body whereby the shoulder portion on the front end of the core body contacts tightly against the funnel shaped axial hole on the front axial end of the main body to form a closed position. A guiding orifice is provided on the wide attachment face at the front end of the closed segment. By pressing the front end of the core body, the fluid in the container tank is released to flow through a guiding orifice and further permeate into the attachment face. The front end of the pin shaped core body forms a plane with rounded angles. The width of the guiding orifice is smaller than or equal to the axial width of the front end of the core body such that the section of the front end thereof covers the laminated faces of the guiding orifice and there is no visible gap between the two. During application, the notch portion of the guiding orifice is flattened by the top end of the core body, thus a flat and even application face is formed.

Another object of this invention is to provide an arrangement wherein a cross shaped throttling hole is formed on the end face of the end stopper and a plurality of axial throttling holes on the peripheral edge thereof with a proper gap maintained between the inner end face of inner hole of the end stopper and the axial end of the pin shaped core body. By pressing down the front end of the core body, the axial end thereof inside the end stopper will act as a piston in the cylinder to sufficiently stir up the fluid in the container tank body. The fluid will flow through the double path provided by the throttling holes on the end face of the end stopper and the peripheral edge into the axial hole of the main body whereby the fluid necessary for the attachment face to perform wide face application is continuous. Since the cross shaped throttling hole of the end stopper and the plurality of throttling holes on the peripheral edge are tiny gaps which serve to filter out solidified objects while the fluid is pumped in whereby the solidified objects due to long term of storage are prevented from flowing into the throttling hole of the end stopper.

A further object of this invention is to provide an arrangement wherein both sides of the front axis of the main body are flat faces, the end segment is a gradually withdrawing curved face or a plane up to the end face to preserve an attachment face of a plane segment, and the angles on the corner are rounded, to provide a smooth broad and narrow side attachment face for application. The face and the axis body may be perpendicular to each other to form a flat mouth, or they may form an oblique angle for more convenience in holding and applying with the posture of holding a pen.

Still another object of this invention is to provide an arrangement wherein the axial hole from the front axial closing segment of the main body to the attachment face segment is gradually larger outwardly whereby after completion of application the remainder of the fluid or the solidified objects attached to the inner side of the outlet on the front end of the core body are easy to clean.

BRIEF DESCRIPTION OF THE DRAWINGS

The aforementioned objects, features and effects can be further substantially understood from the following detailed description of the embodiments with reference to the accompanying drawings, wherein:

FIGS. 1 (B), (C) and (D) are plane views of the end of front axis; and FIG. 1 (E) is a partial sectional view of the embodiment.

FIGS. 2-1 to 2-2 illustrate the prior art of Taiwanese Patent Publication No. 325028 (hereinafter referred to as the second published example), wherein FIGS. 2-1(A) and 2-2 (A) are perspective views of two embodiments; FIGS. 2-1 (B) and 2-2 (B) are front views; and FIGS. 2-1 (C) and 2-2 (C) are sectional views.

FIG. 2-3 is a schematic view showing the steps before and after use according to the second published example, wherein FIG. 2-3 (A) illustrates the case before pressing; FIG. 2-3 (B) illustrates that after pressing the fluid forms into drops in front of the guiding orifice; and FIG. 2-3 (C) illustrates the application face after application.

FIG. 2-4 illustrates the usage state of the second published example, wherein FIGS. 2-4 (A) and 2-4 (B) show that the section of the applied film has two projected application faces.

FIG. 2-5 is a partial sectional view of the pen tip contacting portion according to the second published example, wherein FIGS. 2-5 (A) and 2-5 (B) respectively show the phenomenon within the pen tip from the closed segment to the vertical segment on top of the pin shaped head portion when seriously stuck with fluid.

FIG. 2-6 is a partial sectional view of the front portion of the pen combined with the seat according to the second published example, illustrating that the inlet on the terminal end of the pin shaped body is too small and therefore easily blocked to cause difficulty in supplying a proper quantity of fluid.

FIG. 3-1 is an exploded sectional view of an applicator according to this invention.

FIG. 3-2 is a sectional view as of the applicator shown in FIG. 3-1.

FIG. 3-3 is a sectional view of the first preferred embodiment relating to the main body according to this invention.

FIG. 3-4 is a partial cut-away perspective view of the main body as shown in FIG. 3-3.

FIGS. 3-5 (A) and (B) are enlarged sectional views of a partial front axis according to this invention, illustrating a schematic view of the configuration of a guiding orifice and a top end of the pin shaped core body.

FIGS. 3-6 (A) and (B) are schematic views of and end stopper in combination with the end of the pin shaped core body forming a double path.

FIG. 4-1 is a perspective view of a main body of the second preferred embodiment according to this invention, wherein a part has been cut away to show the main body and the seat being formed integrally.

FIG. 4-2 is a perspective view of the main body of the third preferred embodiment according to this invention, wherein a part has been cut away to show the configuration of an insertion type front axis portion.

FIGS. 5 (A)–(I) are a practical embodiment of the front axis portion according to this invention, illustrating various configurations of an attachment face, a guiding orifice and a throttling hole.

FIGS. 6 (A)–(D) illustrate a practical embodiment of the insertion type front axis portion shaped by metal cutting according to this invention.

FIGS. 10-1 and 10-2 show a schematic view of the practical embodiment of the front end of the core body forming a wide flat configuration according to this invention.

FIG. 11 (B) is a plan view; and FIGS. 11 (C—C) and (D—D) are respectively a lengthwise and crosswise sectional view taken along lines C—C and D—D in FIG. 11(B).

FIG. 12 (B) is a partial sectional view in a using state; FIG. 12 (C—C) is a partial sectional view as shown in FIG. 12 (B) along line C—C; FIG. 12 (D) is a partial perspective view in a using state; and FIG. 12 (E) is a cross sectional schematic view of the embodiment relating to non-penetrating type scraper.

FIGS. 14-1 and 14-2 show an alternate practical embodiment of a double path of the end stopper according to this invention, wherein FIGS. 14-1 (A) and 14-2 (A) are a partial cross section perspective view; FIGS. 14-1 (B) and 14-2 (B) are a perspective view cut-away in half; and FIG. 14-3 illustrates the practical embodiment of a blockage prevention end stopper according to this invention.

DETAILED DESCRIPTION OF THE PREFERRED EMBODIMENT

Figures 2, 3, 4, 5, 5B:
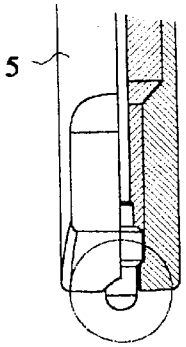
FIG. 2-5B ( PRIOR ART )
Figures 2, 3, 4, 5, 5A:
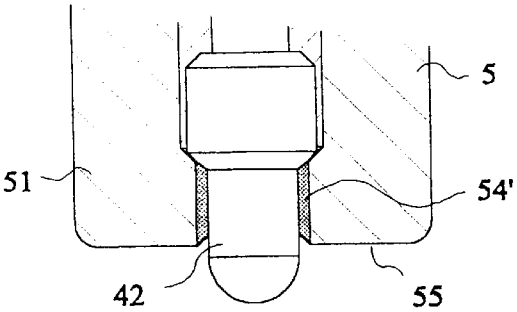
FIG. 2-5A ( PRIOR ART )
Figures 1, 3:
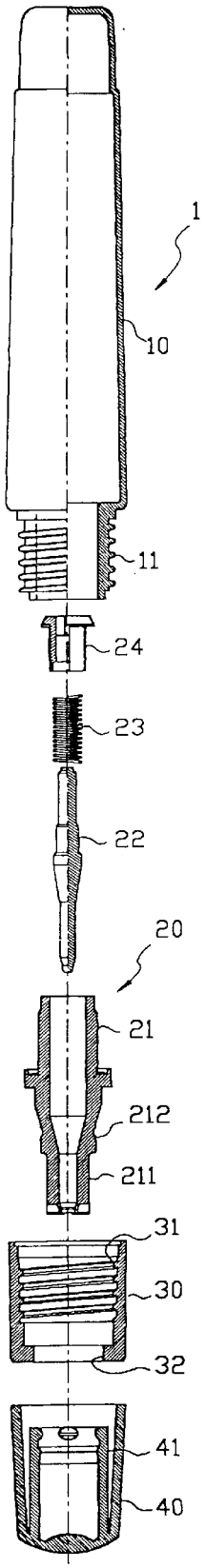
Figures 2, 3:
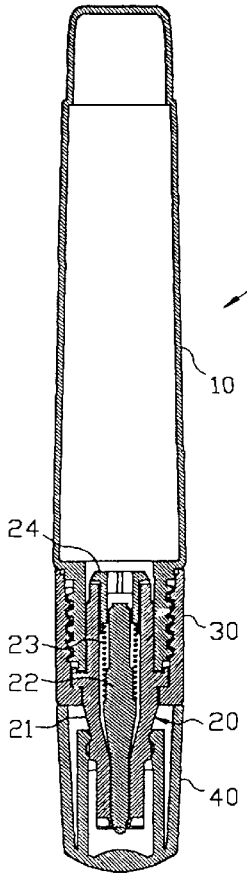
Figure 3:
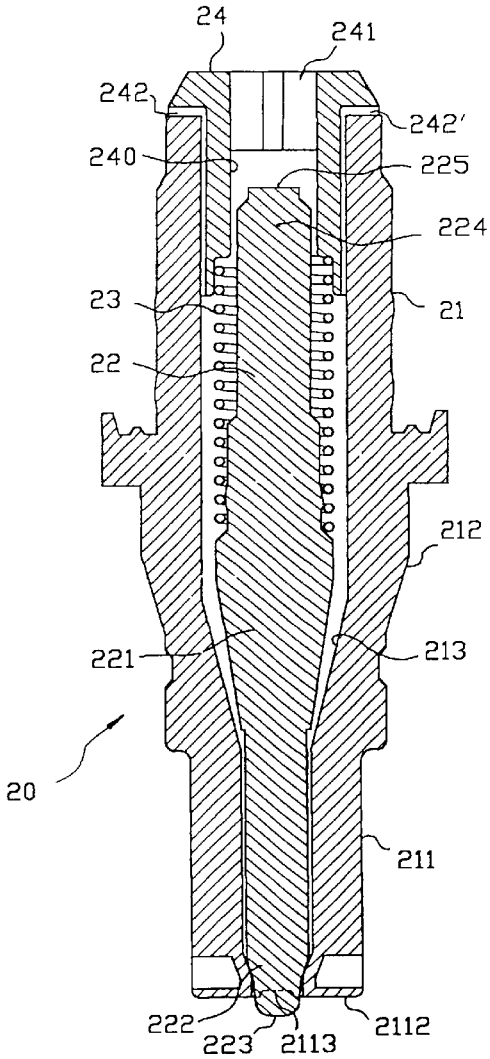
Figures 2, 4:
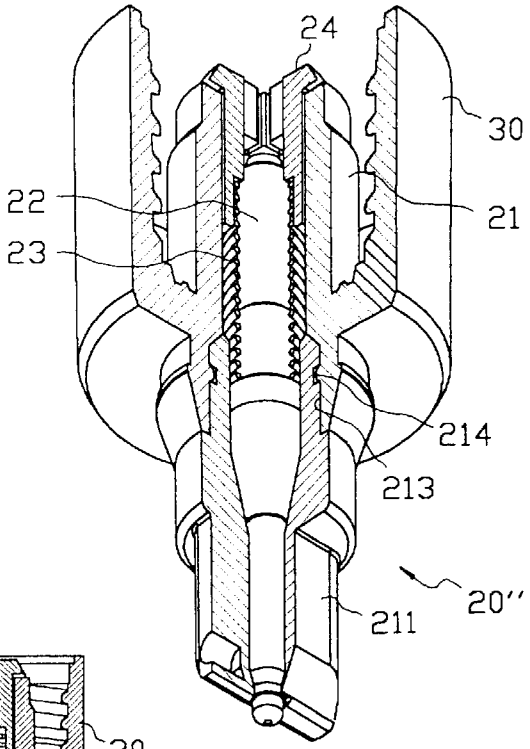
Figures 2A, 4:
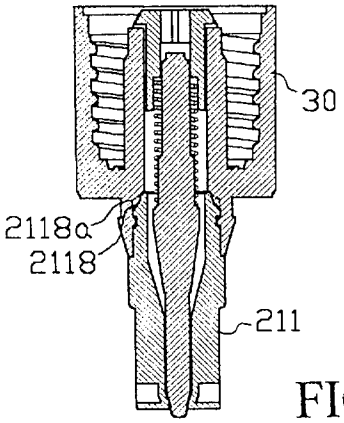
Figures 1, 4:
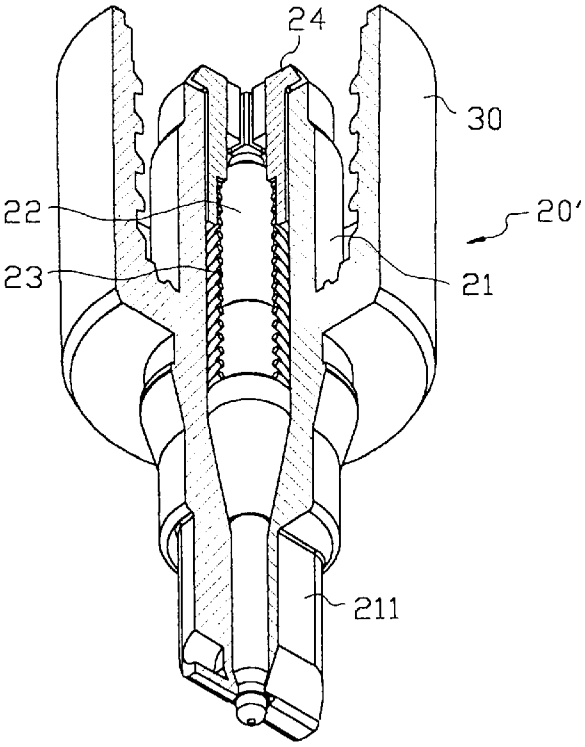
Figures 3, 4:
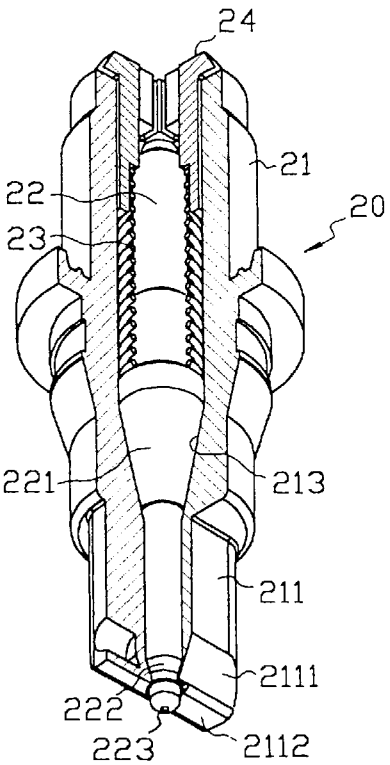

Referring to FIGS. 3-1 and 3-2, a new construction of a wide faced applicator 1 adapted to various kinds of fluid according to this invention comprises a container tank 10 formed in any shape for holding with a hand and having a threaded portion 11 at the front end and which serves for receiving fluid such as correction liquid, ink, adhesive, paint or wax, etc; a main body 20 formed by a body 21, a pin shaped core body 22, a spring 23 and an end stopper 24, a flat front axis portion 211 formed at the front end and a tapered flange portion 212 formed on the outer edge; a seat 30 having a flange 32 on the front end of the inside diameter hole to engage with the flange portion 212 on the outer edge of the body 21, and an inner edge threaded portion 31 to threadedly engage with the threaded portion 11 at the front end of the container tank 10; and a cover 40 which engages with the front axis portion 211 of the body 21, having a liner 41 to insert into the front end of the flange portion 212, the cover 40 being integrally formed with the liner 41 for convenience of reuse Further referring to FIGS. 3-3 and 3-4, the main body 20 according to this invention is arranged such that both sides of the front axis portion 211 are flat faces formed by cutting; the end segment 2111 is a gradually shrinking curved face or flat face toward the bottom end face which reserves a flat face segment, so as to form a wide, narrow sided applying attachment face 2112 on the axial end; the body 21 is provided with multiple funnel shaped axial hole 213 from top to bottom; a pin shaped core body 22 is inserted within the axial hole 213; to match with the multiple funnel shaped axial hole 213 of the body 21, the pin shaped core body 22 is arranged such that a middle segment 221 and a shoulder 222 at the top end are conical shapes, and the top end face 223 is a plane with rounded angle, while the rear end of the core body 22 is a gradually reducing diameter shaft, and the bottom end face 225 is a plane; a tension spring 23 is engaged with the outer edge of the rear end of the core body 22, the front end contacts tightly against the flange of the conical middle segment 221 of the core body 22; and an end stopper 24 is provided with a flange on the top; a cross shaped throttling hole 241 is provided in the center of the end face of end stopper 24, a plurality of throttling holes 242 are provided, 242' on a quarter circle point of the outer circumference and the flange, and the inner edge has an inner diameter hole 240, the outer edge of which inserts into the axial end of the body 21, the inner hole 240 is loosely engaged with the axial end 224 of the core body 22 and the concave portion thereof receives the rear end of the tension spring 23 so that the top end shoulder 222 of the core body contacts tightly the funnel shaped axial hole at the front end of the body 21 to achieve a locked state, and guiding orifices 2113 are provided on both sides of the attachment face 2112 at the front end of the locked segment. By pressing down the top end 223 of the core body 22, the fluid inside the container tank 10 will be released and permeate into the attachment face 2112 under the guidance of the guiding orifices 2113. In use, by lightly pressing the top end 223 of the core body and pulling the attachment face 2112, a wide application face can be achieved.

Further, as shown in FIG. 3-5 (A), the attachment face 2112 of the applicator 1 may be flat and perpendicular to the front axis portion 211, or alternatively it may be oblique as shown in FIG. 3-5 (B) illustrating that a proper slant angle is formed between the attachment face 2112 and the front axis portion 211 for facilitating holding and applying at an angle and the posture of holding a pen. The primary characteristics of this invention in the structure design is as shown in FIGS. 3-5 (A) and (B) arranged such that the shape and the height of the guiding orifices 2113 are designed to satisfy the highest flow thickness of the fluid as needed and based on the various viscosities of the fluid, the width is limited to being smaller or equal to the axial width of the top end 223 of the pin shaped core body 22. The top end 223 of the pin shaped core body is a plane with rounded angles at the corners so that in a laminated position, the section of the top end 223 covers the notch of the guiding orifices 2113. Even if the top end 223 is pressed, the notch of the guiding orifice 2113 will not form a visible notch on both sides of the top end. Therefore, during application, the notch portion of the guiding orifices 2113 will be flattened by the top end 223 of the core body to form a flat and even application face.

Referring to FIG. 3-6, another characteristic of this invention is shown such that the end 224 of the pin shaped core body 22 and the end stopper 24 form a double path as shown in FIGS. 3-6 (A) and (B). The end stopper 24 is provided with a flange on top, a cross shaped throttling hole 241 in the center of the end face, a plurality of grooves on a quarter circle of the outer circumference and the lower edge of the flange, the outer edge thereof joins to the end of the main body 20 to form a plurality of throttling holes 242, 242' at the joining interface. Inside the end stopper 24 there is an inner diameter hole 240 to loosely engage with the end 224 of the pin shaped core body 22 and a proper gap is maintained between the inner end face of the inner diameter hole 240 and the end face 225 at the end 224 of the core body 22. By pressing the top end 223 of the core body 22, the rear end 224 produces a double path pumping action inside the inner diameter hole 240 of the end stopper 24. For example, when the end 224 of the core body axis moves backward, the fluid inside the inner diameter hole 240 of the end stopper is squeezed out through the cross shaped throttling hole 241 on the top end, and simultaneously the fluid inside the container tank 10 is pumped in through the plurality of throttling holes 242, 242' on the peripheral edge. When the end 224 of the core body axis moves forward, the fluid inside the axial hole 213 of the body 21 is squeezed out through the plurality of throttling holes 242, 242' on the peripheral edge of the end stopper 24, and simultaneously the fluid inside the container tank 10 is pumped in through the cross shaped throttling hole 241 on the end face of the end stopper 24. Thus, the fluid can be supplied continuously as demanded for the wide face application. As described above, when the end 224 of the core body axis moves inside the inner diameter hole 240 of the end stopper, the fluid is pumped out and in, or in and out through the throttling holes 241, 242, 242' of a double path, having the effect of sufficiently stirring up the fluid. Moreover, as the openings of the throttling holes 241, 242, 242' are small, any solidified objects are filtered out when the fluid flows in and out the throttling holes 241, 242, 242' to prevent the solidified objects of the fluid formed by long term storage from entering and blocking the throttling holes in the end stopper. As shown in FIG. 3-6 (A), a single ball or a plurality of balls 111, 111' or blocks in any shape may be placed inside the container tank 10 to enhance the stirring up effect of the fluid.

According to the pumping arrangement of the double path indicated above, a plurality of groove holes in any shape are provided on the end face of the end stopper, and a plurality of hollowed grooves or holes are provided on the peripheral edge of the end stopper to form the throttling holes of a double path. Further, any ball or block of proper shape can be placed inside the inner diameter hole 240. Though the ball or block is not integral with the pin shaped core body, through the action of the core body, a similar pumping action may be effected inside the inner diameter hole of the end stopper, and it should belong to the equality changing example of this invention.

FIG. 4-1 shows the second preferred embodiment of a main body 20' according to this invention. The structure of this embodiment is similar to the aforementioned embodiments except the body 21 and the seat 30 are an integral structure so as to reduce the quantity and kind of elements.

Figures 2, 3, 4, 5, 6:
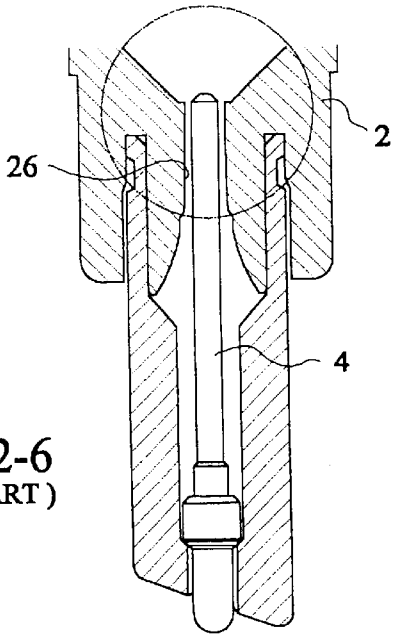
FIG. 2-6 ( PRIOR ART )
Figures 2, 3, 4, 4A:
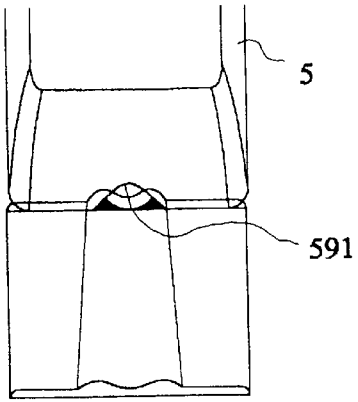
FIG. 2-4A ( PRIOR ART )
Figures 2, 3, 4, 4B:
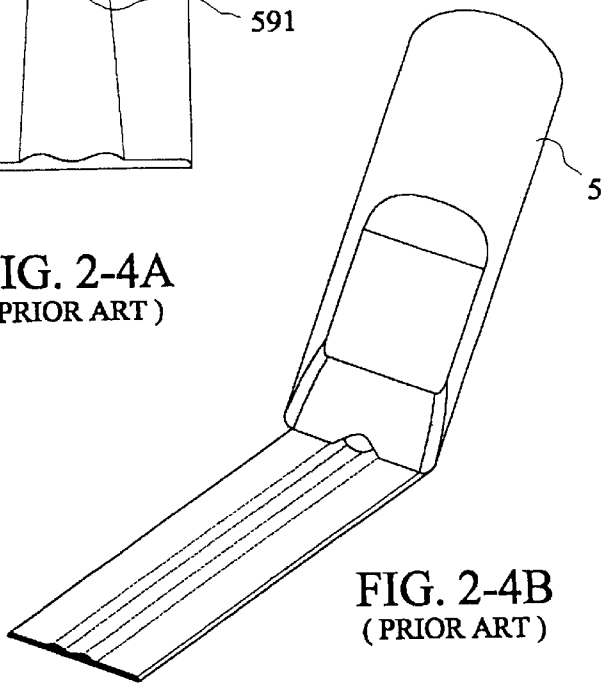
FIG. 2-4B ( PRIOR ART )

FIG. 4-2 shows the third embodiment of a main body 20" according to this invention, it is the same as the aforesaid two embodiments except the body 21 and the seat 30 are integrally formed and the front axis portion 211 is of insertion type to accommodate a front axis portion 211 formed with different materials; for example, metal cutting formation (as shown in FIGS. 6A–D) or plastic material injection formation (as shown in FIGS. 7 A–D). As shown in FIGS. 6 and 7, an engaging recess 2116 is provided on the peripheral edge of the end of axis portion in the front axis 211, and a flange 2117 is provided on the front end of the engaging recess 2116. An axial hole 213 matching with the front axis portion 211 in configuration is provided on the front end of the main body 20" with a flange 214 provided on the inner edge of the axial hole 213. A positioning slot 2118 (as shown in FIGS. 7A–D) is provided on the flange 2117 in the axial end of the front axis portion 211 and a tenon 2118*a* (see FIG. 4-2) matching with the positioning slot 2118 is provided on the inner edge of the axial hole 213 at the front end of the body 21 such that both engage with each other in a proper limited angle.

The axis of the main body 20, 20' 20" according to this invention may be made of a material allowing for recycling such as P.P., P.E., nylon, resin and other engineering plastics by injection molding and will be shrunk and deformed during melting, molding, cooling and stripping processes due to their greater shrinkage rate. The front axis portion 211 is an element of high precision and for the sake of achieving expected concise shrinkage as well as of reducing inferiority rate, a shrinkage and deformation prevention hole 2114 is provided on the front axis portion 211. For example, as shown in FIG. 3-5 (A), on either side of the narrow face adjacent to the attachment face 2112 of the front axis portion 211, a circular shrinkage and deformation prevention hole 2114 parallel to the attachment face 2112 is provided.

Figure 8B:
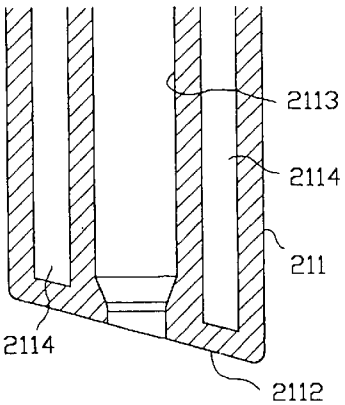
FIG. 8 illustrates a schematic view of the embodiment of a throttle deformation prevention hole of the front axis portion concealed inside the wall according to this invention.
Figure 8A:
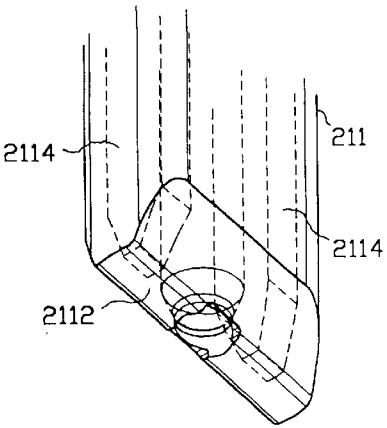
Figure 11A:
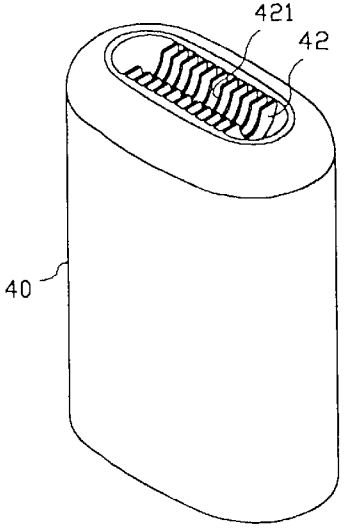
FIG. 11 shows the practical embodiment according to this invention wherein a scraper is provided on a cover, wherein FIG. 11 (A) is a perspective view.
Figure 11B:
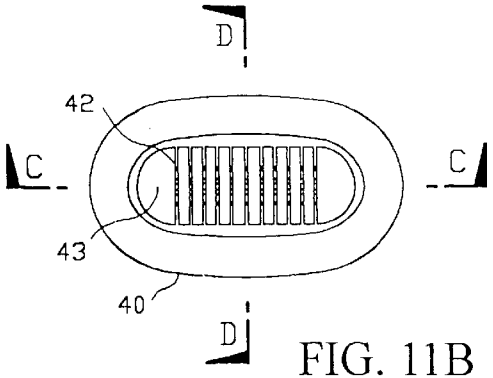
Figure 11C:
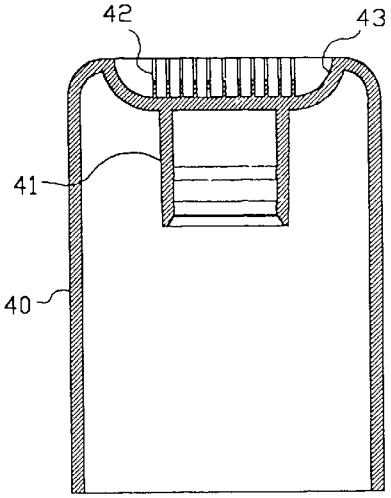
Figure 11D:
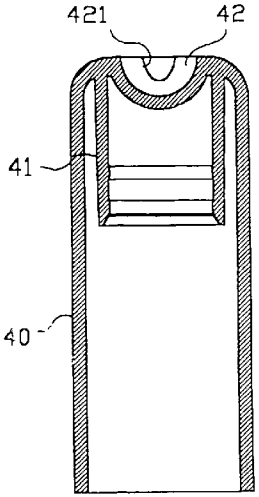
Figure 12C:
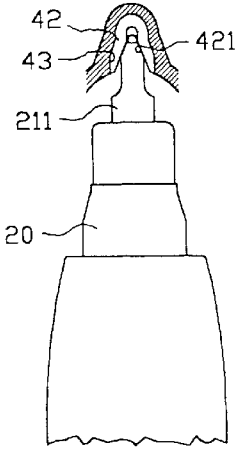
FIG. 12 shows the practical embodiment according to this invention wherein a scraper is provided on the inner side of a transparent cover, wherein FIG. 12 (A) is a partial sectional view in an assembled state.
Figure 12E:
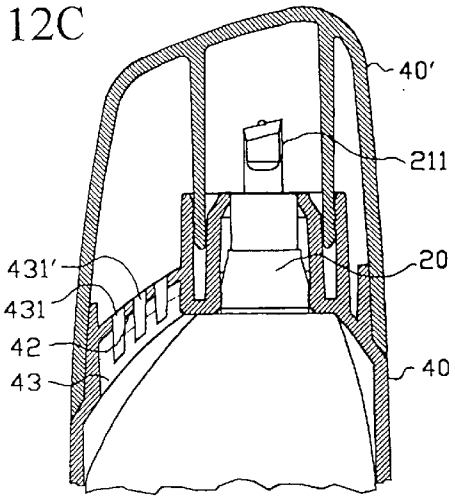
Figure 12B:
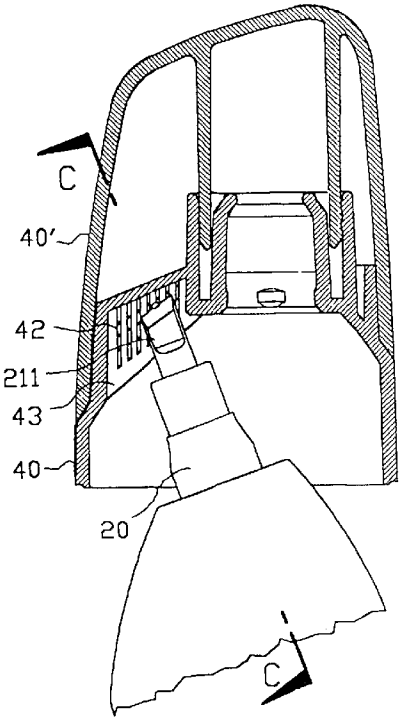
Figure 12A:
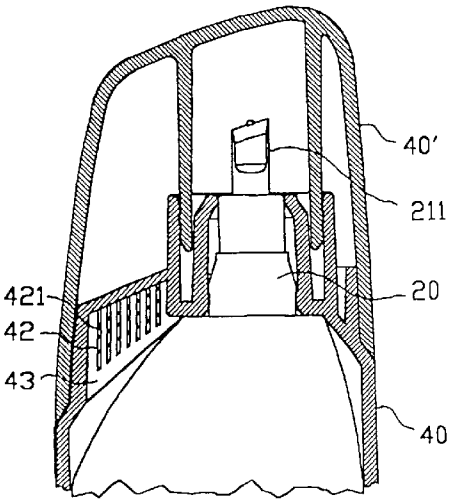
Figure 12D:
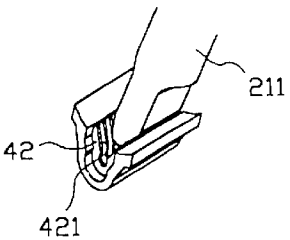

As to the practical embodiments using the shrinkage and deformation prevention hole 2114 of such type, please refer to the integrally molded front axis portion 211 of the flat and the oblique type as shown in FIGS. 5 (E)–(H), and the insertion type injection molded front axis portion 211 as shown in FIGS. 7 (A), (B). FIGS. 3-5 (B) further shows an overall shrinkage prevention design on the front axis portion 211. As shown, on either side of the narrow face of the flat segment of the front axis portion 211, a lengthwise long groove hole is provided to serve as the shrinkage and deformation prevention hole 2114, the inner edge of which is parallel to the axial hole 213 and the attachment face 2112. As to the practical embodiments using the shrinkage and deformation prevention hole 2114 of such type, please refer to the integrally molded front axis portion 211 of the flat and the oblique type as shown in FIGS. 5 (A)–(D) and 5 (I), and the insertion type injection molded front axis portion 211 as shown in FIGS. 7 (C) & (D). Further, in FIG. 8 is shown a hidden type shrinkage prevention design. As shown, on either side of the narrow face of the flat segment of the front axis portion 211, a lengthwise long groove hole hidden within the wall is provided to serve as the shrinkage and deformation prevention hole 2114, the inner edge of which is parallel to the axial hole 213 and the attachment face 2112.

As shown in FIGS. 3-5 (A), (B), the axial hole 213' from the front end of the locked segment 2115 of the front axis portion 211 to the attachment face 2112 gradually enlarges outwardly whereby in using a fluid with high viscosity or high volatility and of easy solidify nature, the solidified objects stuck onto the axial hole 213' at the outlet of the top end 223 after application are easy to remove so as to keep the top end 223 clean. Besides, as shown in FIGS. 3-5 (A), (B), the special feature in design of the guiding orifice 2113 on the wide face side of the attachment face 2112 of the front axis portion 211 is that the shape of the notch can be parallel forming the attachment face 2112 to a rectangle, or according to a demand of various kinds of fluid forming a curved opening. The height of the notch is the greatest flowing thickness needed by the fluid, while the width of the notch is smaller than or equal to the axial width of the top end 223 of the core body, and is gradually enlarges outwardly. The guiding orifice 2113 may be single in number placed on one side of the wide face side of the attachment face 2112 to allow one way application, or may be single in number placed on both sides of the wide face side of the attachment face 2112 to allow double way application. For the practical embodiments of this part, please refer to the guiding orifice 2113 of flat and oblique type on one side and both sides of the integrally formed front axis portion 211 as shown in FIGS. 5 (A)–(I); the guiding orifice 2113 of flat and oblique type on one side and both sides of the metal cut type front axis portion 211 of insertion type as shown in FIGS. 6 (A)–(D); and the guiding orifice of flat and oblique type on one side or both sides of the injection molded front axis portion 211 of the insertion type as shown in FIGS. 7(A)–(D).

Figures 3, 4, 5, 6, 6B:
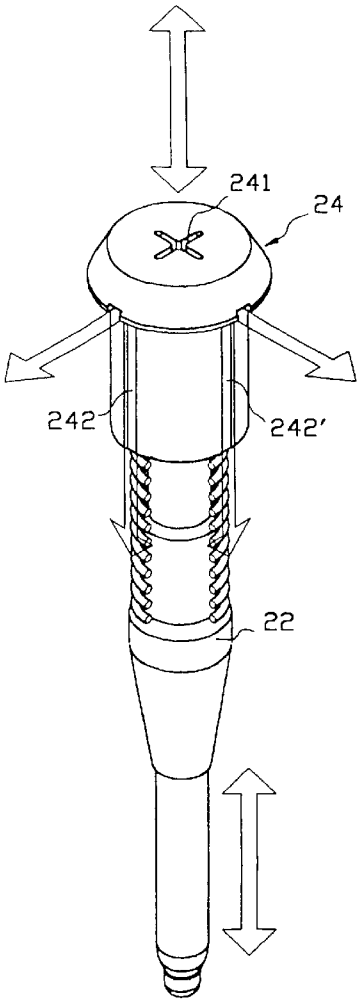
Figures 3, 4, 5, 6, 6A:
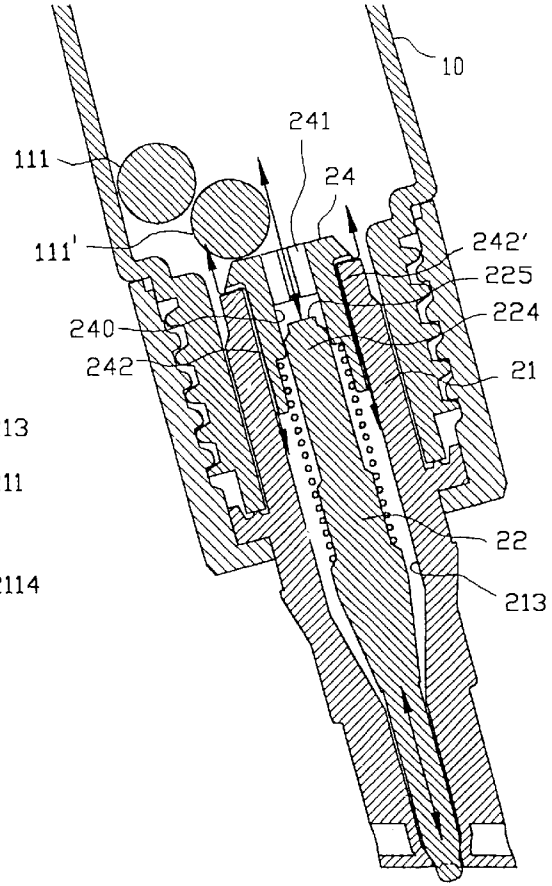
Figures 3, 4, 5, 5B:
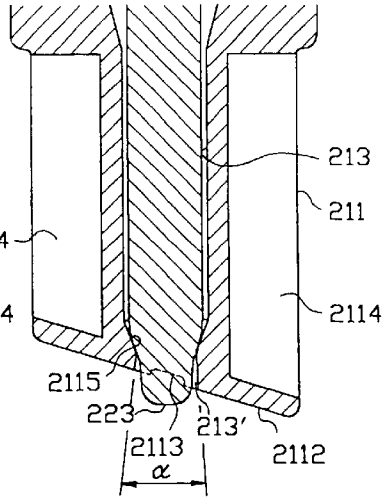
Figures 3, 4, 5, 5A:
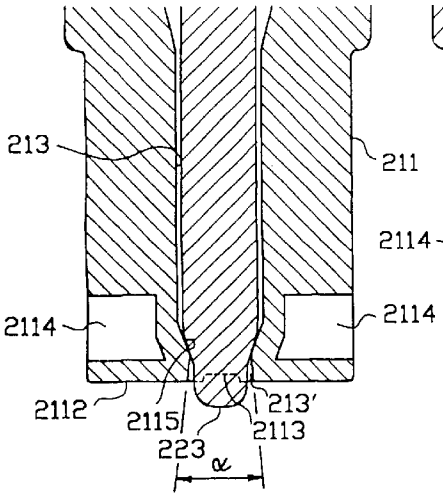
Figures 5A, 5B, 5C, 5D, 5I:
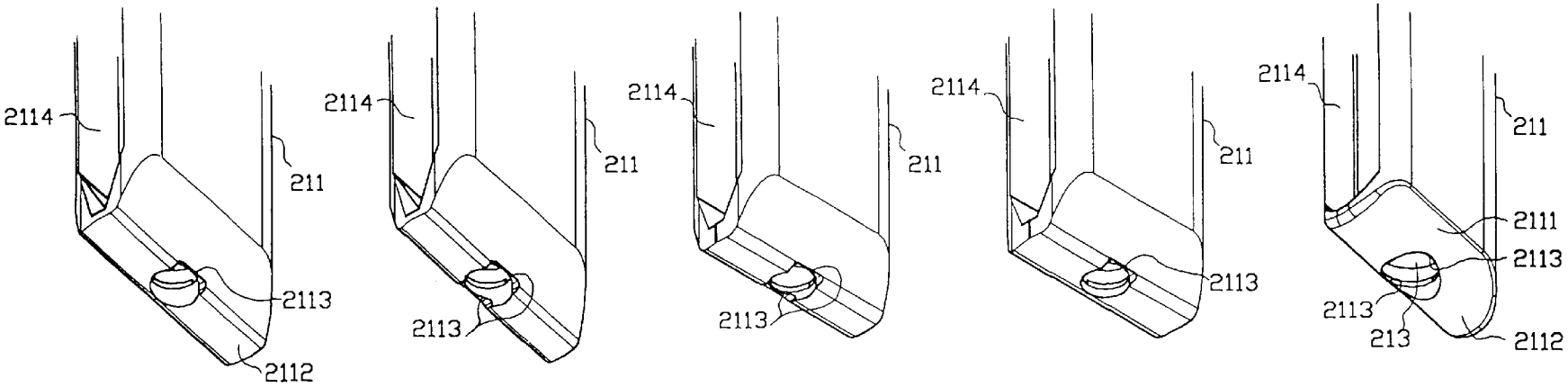
Figures 5E, 5F, 5G, 5H:
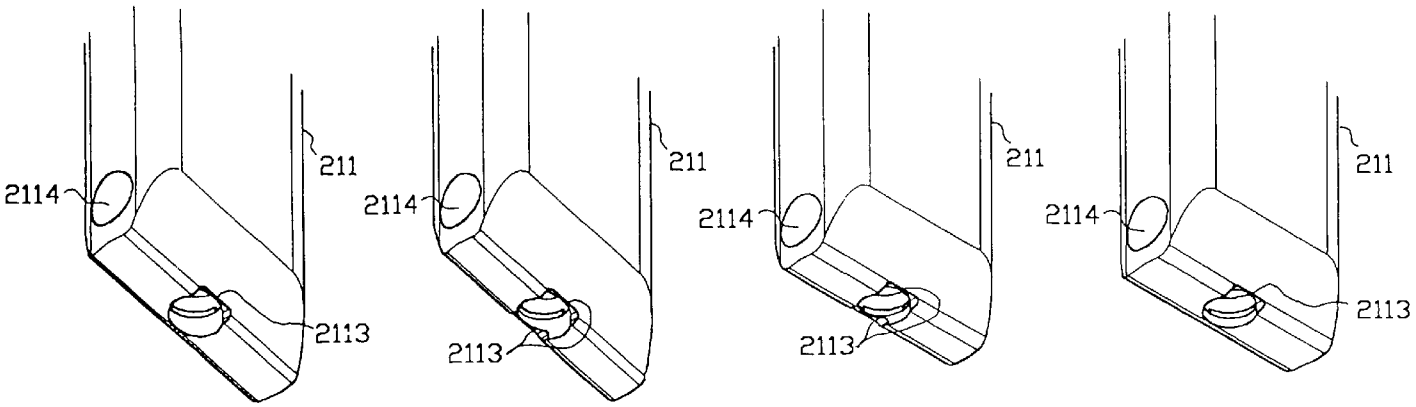
Figure 6A:
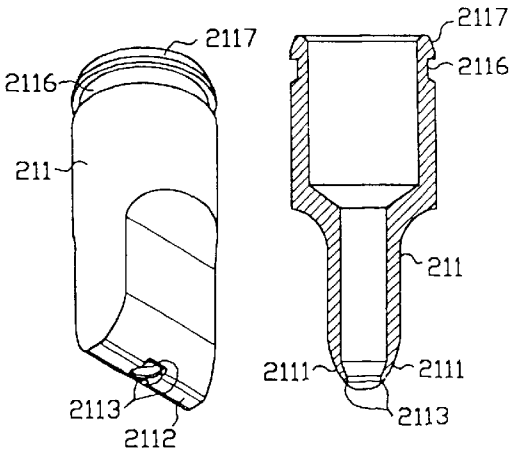
Figure 6B:
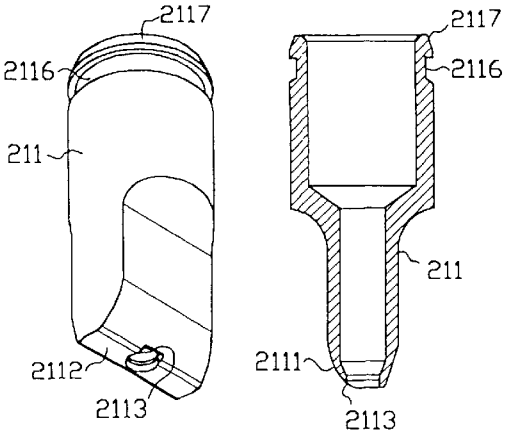
Figure 6C:
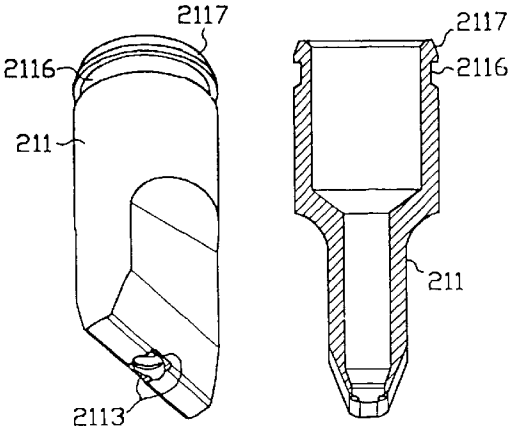
Figure 6D:
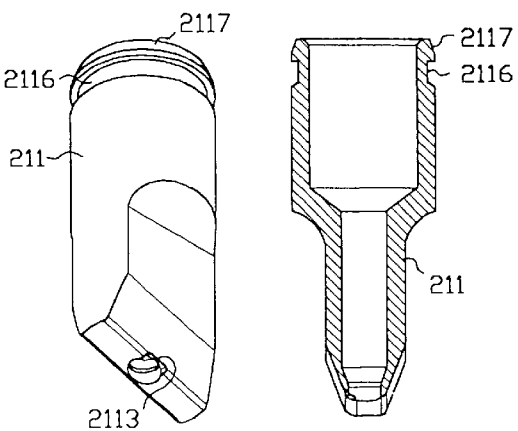
Figure 7D:
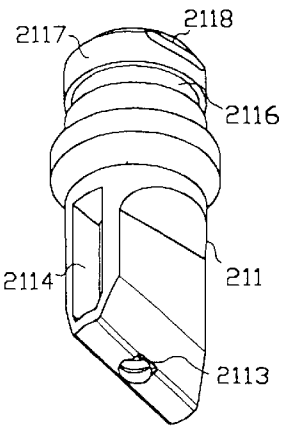
FIGS. 7 (A)–(D) illustrate a practical embodiment of the insertion type front axis portion formed by injection according to this invention.
Figure 7C:
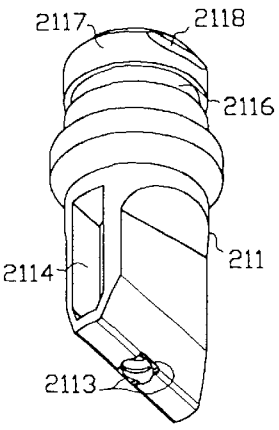
Figure 7B:
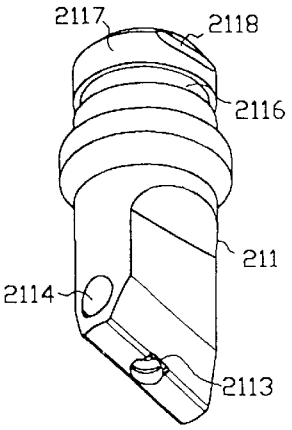
Figure 7A:
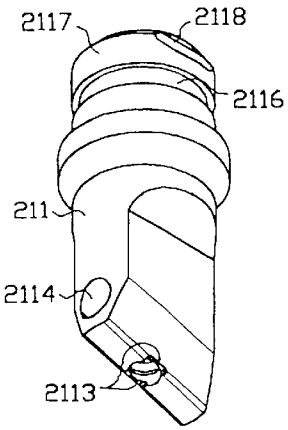

Furthermore, the special feature in practical design which matches the shape of the attachment face with the guiding orifice is that the fluid may fully spread after it is released out of the guiding orifice, and then permeate into the angle formed by the attachment face and the applied face, whereby the fluid under the pressure given by the flat segment of the attachment face may be flattened to adhere uniformly to the applied face. A larger curve is formed on the wide face side of the attachment face so that even if a difference occurs between the originally designed angle and the working gesture of the user, the fluid can be smoothly applied over the given application face. For example, as shown in FIG. 5 (I), a larger curve is provided on both sides of the end segment 2111 of the front axis portion 211 and toward the bottom end face which reserves an attachment face 2112 of the plane segment, accordingly the axial hole 213 on both sides of the curved face of the attachment face 2112 will naturally form a curved opening of the guiding orifice 2113, and will be a rounded angle with a small curve on both sides of the narrow face, thereby lowering the friction coefficient and reducing the fluid flowing outside the given application face. Furthermore, FIG. 6 (A) shows a front axis portion 211 having a double application function, wherein guiding orifices 2113 are provided on both sides, while FIG. 6(B) shows a front axis portion 211 having single way application function, wherein a guiding orifice 2113 is provided on only one side. As shown in FIGS. 6 (A) and (B), the axial end 2111 having the guiding orifice 2113 on the applying direction side is a larger curved face so as to have the lowest friction coefficient with the given application face, and there is a larger plane segment in the attachment face 2112 of the bottom end.

Figure 9B:
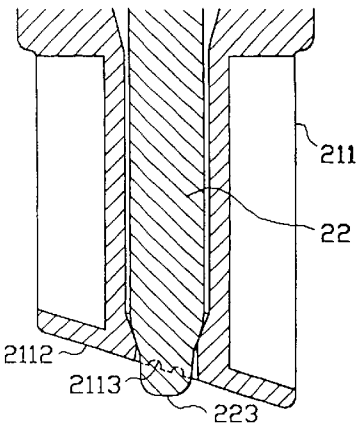
FIGS. 9 (A) and (B) are enlarged sectional views of a partial front axis according to this invention, illustrating a schematic view of the configuration of a plurality of guiding orifices and the front end of the pin shaped core body.
Figure 9A:
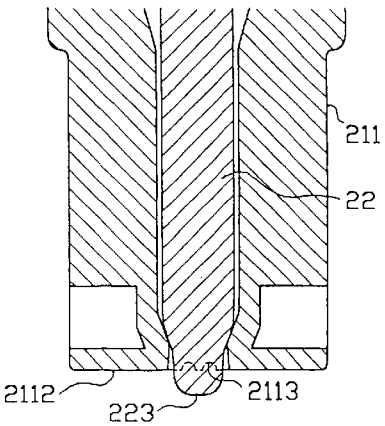

As described above while, the guiding orifice provided on one side of the front axis portion 211 is for a single way application function, wherein the guiding orifice 2113 may be plural in number. Likewise, the guiding orifices provided on both sides of the front axis portion 211 are for a double way application function, wherein the guiding orifice 2113 may also be plural in number. As shown in FIGS. 9 (A) and (B), guiding orifices 2113 may be adapted to fluids of various viscosity, however the total width is limited to less than the axial width of the front end 223 of the core body 22.

According to this invention, the top end 233 of the core body 22 can be designed as wide and flat in shape in order to adapt to an adhesive fluid with low spreading nature. For example, FIGS. 10-1 (A), (B) are lengthwise and crosswise sectional views of the front axis portion 211; and as shown in the perspective view of FIG. 10-1 (C), the wide and flat end 223 of the core body 22 is a brush end face. During pressing the wide and flat end 223 of the core body 22, the fluid released from the locked segment 2115 permeates to the attachment face 2112 through the brush base end. After the brush is pressed, the fluid will flow to the opening end and will be directly apply, and then flattened by the plane segment of the attachment face 2112. Further, as shown in FIGS. 10-2 (A), (B), (C) and (D), a plurality of horizontal notches on the end face of the wide and flat top end 223 of the core body 22 are provided, or a plurality of convex points in any shape, are provided, having rounded corners at the end edge and the notch in order to lower the friction coefficient. A wide guiding orifice 2113 parallel to the attachment face 2112 is provided on one side of the wide face of the attachment face 2112. During pressing the wide and flat top end 223, the fluid released from the locked segment flows through a notch of the guiding orifice 2113 and the plurality of notches at the top end 223 to permeate into the attachment face 2112. After application with the top end 223, the fluid is flattened by the plane segment of the attachment face 2112.

FIGS. 11 (A), (B), (C—C) and (D—D) show a preferred practical embodiment of a scraper 42 provided on the top end of a cover 40 according to this invention. As shown, a dent slot 43 curved longitudinally is provided on the top end face of the cover 40 wherein a scraper 42 formed of a plurality of flexible sheets adjacent to one another with a notch 421 provided individually in the middle of scraper 42 for scraping away the remainder of the fluid or the solidified objects stuck onto the axial hole at the front axis portion 211 so as to keep the top end clean. The scraper 42 may be integral with the cover 40, or engaged with the cover 40 after molding. The scraper 42 may also be arranged on both sides of the wide face of the cover 40, or on both sides of the narrow face or on a proper location along the peripheral edge.

FIGS. 12 (A), (B), (C—C), (D) and (E) show a preferred embodiment of a scraper 42 provided inside the cover 40. As shown in FIG. 12 (A), a neck portion of the cover 40 engages with the main body 20, and a transparent hood 40' is mounted on the cover 40. The transparent hood 40' is installed in the inserting method on the bottom seat of the cover 40 whereby the front axis portion 211 is tightly covered so that the top end does not dry and solidify, and the shape of the front axis portion 211 may transparently be turned up. A dent slot 43 is formed at one side of the inner side of the cover 40, a scraper 42 made of a plurality of flexible sheets is provided on in this slot 43. An axial notch 421 is formed individually in the middle of the scraper 42 for scrapping away the solid objects stuck onto the top end of the front axis portion 211, as shown in FIGS. 12 (B), (C—C) and (D). The scraper 42 may be integral with the cover 40, or engaged therewith after molding. As shown in FIG. 12 (E), the scraper 42 may also be formed with the slot holes not penetrating through the wall thickness. The axial dent slot 43 is formed in one side of the inner side face of the cover 40, and on this dent slot 43 a plurality of recesses 431, 431' which do not penetrate the wall thickness are formed. The wall thickness between the slot hole 431 and the slot hole 431' is formed into a plurality of scrapers 42, which are capable of scraping away the solidified objects stuck onto the top edge of the front axis portion 211.

Figure 13B:
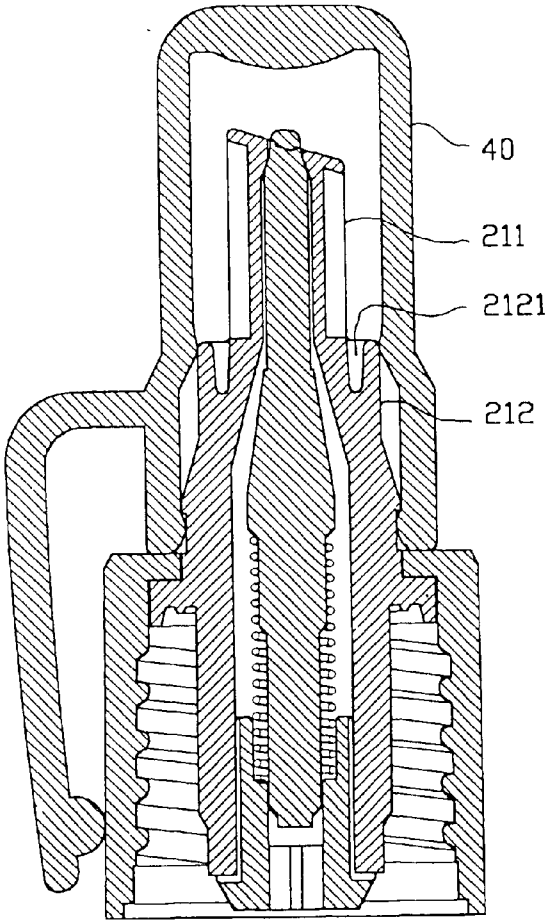
FIG. 13 is a cross sectional schematic view of the embodiment according to this invention showing the cover and the front axis portion flexibly engaged with each other, wherein FIG. 13 (A) is a crosswise sectional view and FIG. 13 (B) is a lengthwise sectional view.
Figure 13A:
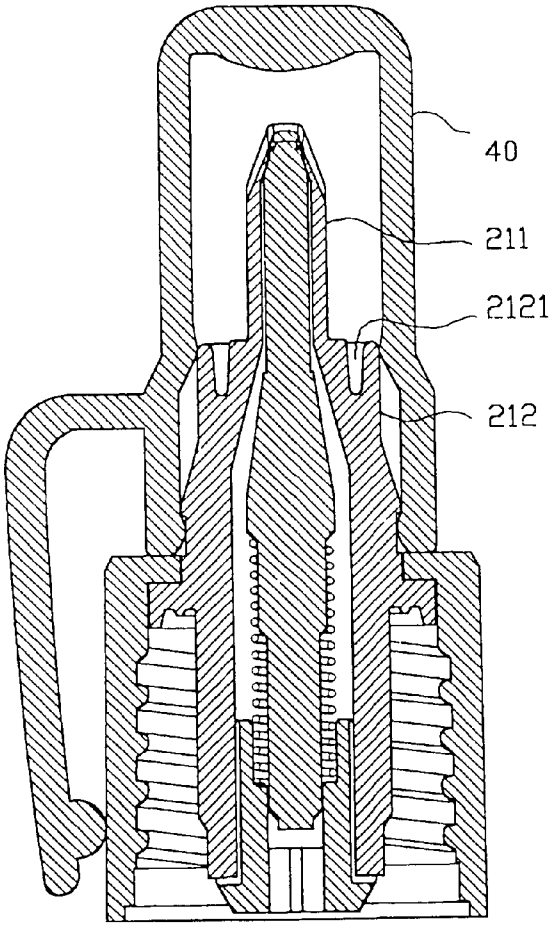

Referring to FIGS. 13 (A) and (B) illustrating a preferred embodiment wherein the flange portion 212 of main body 20 is in engagement with the cover 40. The special feature of this embodiment is that a dent slot 2121 is formed on the projected base portion of the flange portion 212 in the front axis portion 211 of the main body. Thus, the peripheral wall is flexible so that a flexible engagement results which is an improvement over the conventional art which requires a liner to obtain a flexible engagement with the cover.

Figure 1A:
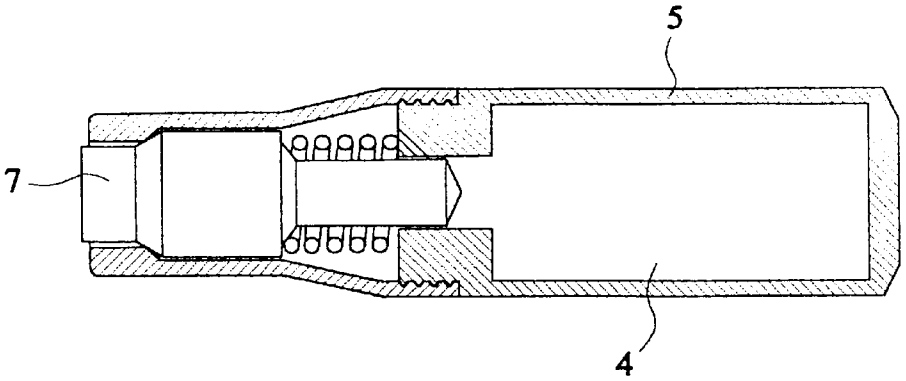
FIG. 1A (PRIOR ART)
FIG. 1 illustrates the prior art of Japanese Utility Model Kai Hei No. 5-31996, wherein FIG. 1 (A) is a sectional view of the embodiment.
Figure 1B:
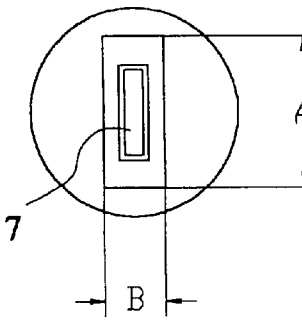
FIG. 1B (PRIOR ART)
Figure 1C:
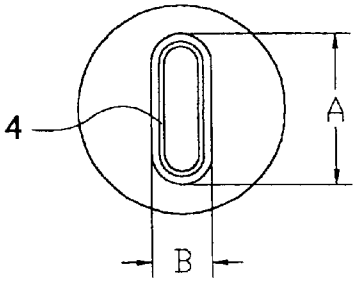
FIG. 1C (PRIOR ART)
Figure 1D:
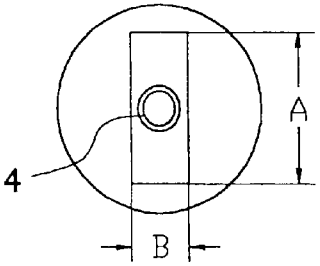
FIG. 1D (PRIOR ART)
Figure 1E:
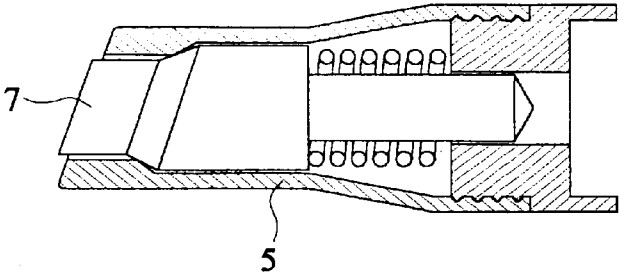
FIG. 1E (PRIOR ART)
Figures 2B, 14:
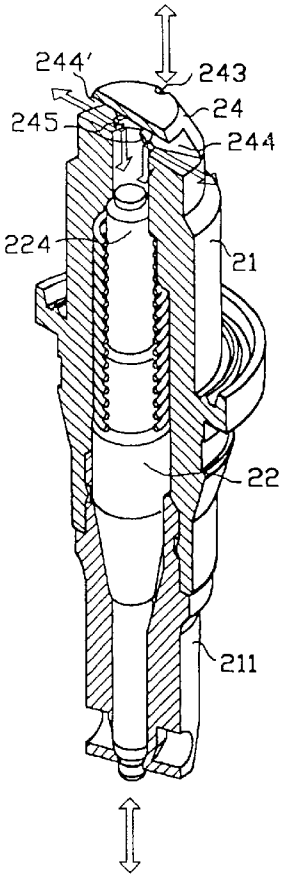
Figures 2A, 14:
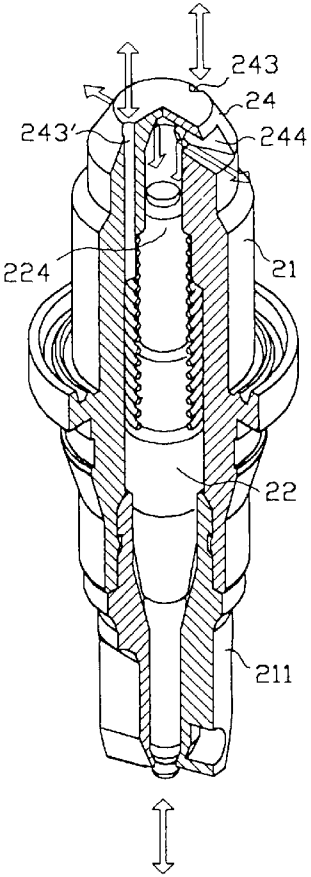
Figures 3, 14:
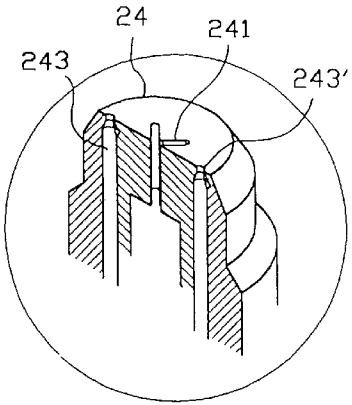
Figures 1B, 14:
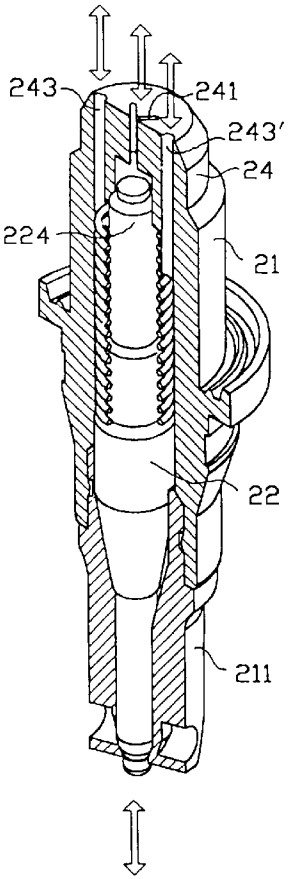
Figures 1A, 14:
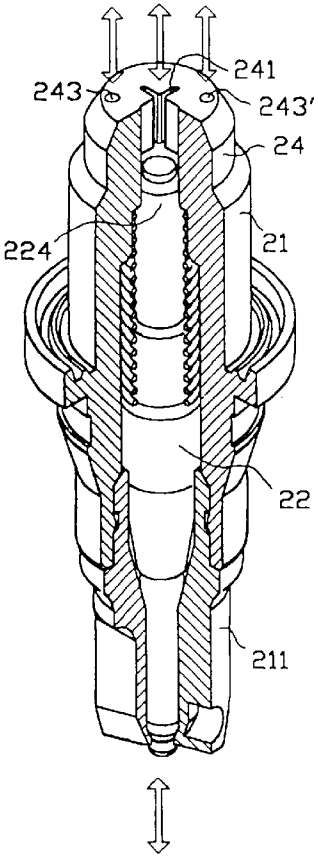

FIGS. 14-1(A) and (B) show an embodiment wherein an end stopper of double path pumping equipment is adapted to the front axis portion of insertion type. This embodiment is different from the aforementioned embodiment in that the end stopper 24 is integral with the axial end of the main body. A cross shaped throttling hole 241 is provided in the center of the upper end face of the end stopper, and a plurality of throttling holes 243, 243' are provided on the outer edge of end face. The throttling holes 243, 243' extend vertically from the end face of the end stopper 24 to the axial side of the pin shaped core body 22 to form double path throttling holes 241, 243, 243'. By pressing the top end 223 of the core body 22, the axial end 224 of the core body will have a round movement inside the inner diameter hole of the end stopper 24, the fluid is pumped out and in or in and out through the throttling holes 241, 243 and 243' of the double path. In case only the cross shaped throttling hole 241 is provided in the middle of the upper end face of the end stopper 24, without providing the other throttling holes in the outer edge, pumping fluid can also be done by a single path throttling hole 241.

FIGS. 14-2 (A) and (B) illustrate another embodiment wherein an end stopper of double path with pumping equipment is applied to a front axis portion of insertion type. As shown, the structure of this embodiment is the same as the aforementioned embodiment, the end stopper 24 is integral with the end of the main body 21. A plurality of circular throttling holes 243, 243' are provided on the outer edge of upper end face of the end stopper 24, and these throttling holes 243, 243' extend vertically from the end face of the end stopper 24 to the axial side of the pin shaped core body 22. A plurality of throttling holes 244, 244' through the wall are provided on the side wall of the upper end of the end stopper 24 in an angle of 90° relative to the axial hole. The shape of the throttling holes 244, 244' are gradually enlarged outward and a grate 245 similar to a filter net device is provided at the inlet of the reverse side to prevent the solidified objects from entering into the inner diameter hole of the end stopper 24. By pressing the front axial end 223 of the core body 22, the end 224 of core body 22 makes a round movement inside the inner diameter hole of the end stopper 24. The fluid is pumped out and in, or in and out through the throttling holes 243, 243', 244, 244' of a double path. If the throttling holes are not provided in the outer end of the upper end face of the end stopper 24, and only the throttling holes 244, 244' in the upper end side wall of the end stopper 24 are provided, they make a single way operation since the flow direction of the fluid and the direction of producing a large quantity of sediment make a 90° turn, the single way structure is not easily blocked.

FIG. 14-3 shows in the aforementioned embodiment wherein a plurality of circular throttling holes 243, 243' are provided on the outer edge of upper end face of the end stopper 24, designed for blocking prevention with a smaller diameter hole formed at the outside outlet end which becomes gradually larger toward the reverse side. When in use the throttling holes 243, 243' are blocked in a reverse position wherein the top end points downward, and when the top end is again actuated, the fluid in the throttling holes 243, 243' is squeezed at a lower speed in a slot hole having a larger diameter, and when the fluid flows to the outlet end with a smaller diameter hole, the fluid is poured into the outlet at a higher speed to eliminate the blocking phenomenon.

To sum up all the foregoing, by utilizing this invention which is capable of using fluids with various viscosities to apply out a flat and even wide application face is indeed an invention of novelty having a practical value. It would be obvious to those skilled in the art that various changes and modifications can be made without departing from the spirit and scope of the invention. It is not apart from the equality changes and modifications made in the appended claims, accordingly it should belong to the category of this invention.

What is claimed is:

1. A wide faced applicator adapted to various kinds of fluid comprising a container tank, forming a threaded portion at its front edge; a main body, forming two spaced apart flange portions on its outer edge; a seat engaged with one of the flange portions on the outer edge of the main body to threadingly connect with the container tank; and a cover engaging with the front end of the main body, having a liner to insert onto the second of the two flange portions, wherein a flat cut face on opposite sides of a front axis portion of the main body forms a wide and narrow sided attachment face; a funnel shaped hole is formed at the axis center of the main body; a pin shaped core body is slidably received in the funnel shaped hole; a spring is engaged with a rear end edge of the core body; an end stopper has a bottom end which is tightly contacted against one end of the spring, an inner diameter hole of the end stopper is loosely engaged with the rear end of the pin shaped core body, and the outer edge of the core body is engaged with an axial end of the main body whereby a shoulder on a top end of the core body contacts tightly against the funnel shaped hole at a front axial end of the main body to form a locked shape; and a plurality of guiding holes are provided on the attachment face of the main body at its front end whereby the fluid in the container tank can be released by pressing an end of the core body adjacent the attachment face, and guided to permeate into the attachment face via the guiding holes, characterized in that the end of the pin shaped core body adjacent the attachment face is a plane with circular angles, the width of the guiding holes on the wide face side of the attachment face of the front axis portion of the main body is smaller or equal to the axial width of the end of the core body adjacent the attachment face, during an applying process, the guiding holes are flattened by the end of the core body adjacent the attachment face to produce a flat and even wide application face; and a plurality of throttling holes are provided on an end face of the end stopper and also on the peripheral edge, a proper gap is maintained between an inner face of the inner diameter hole in the end stopper and the rear end edge of the core body, so that by pressing the end of the core body adjacent the attachment face, an end of the inner diameter hole of the end stopper produces a pumping operation, and simultaneously when making a round movement at the end of the core body adjacent the attachment face, the fluid in the throttling holes on the end face of the end stopper and the peripheral edge pump out and in, or in and out, as a result of which the fluid in the main body is stirred up uniformly to easily flow to the guiding holes and continuously supply the need for the wide face application.

2. A wide faced applicator adapted to various kinds of fluid as claimed in claim 1, wherein the pin shaped core body matches with the funnel shaped hole of the main body in configuration in that the middle portion and the top end shoulder portion is formed having a conical shape; the end adjacent the attachment face is a plane with round angles; and the rear end is a projecting shaft gradually reduced in diameter with a flat end face.

3. A wide faced applicator adapted to various kinds of fluid as claimed in claim 2, wherein the axial width of the end of the pin shaped core body adjacent the attachment face is larger than or equal to the width of the guiding holes, and when the end is pressed, the section of the end adjacent the attachment face will cover the guiding holes.

4. A wide faced applicator adapted to various kinds of fluid as claimed in claim 1, wherein the end of the pin shaped core body adjacent the attachment face is wide and flat.

5. A wide faced applicator adapted to various kinds of fluid as claimed in claim 4, wherein the wide and flat end face of the pin shaped core body adjacent the attachment face is a brush end face.

6. A wide faced applicator adapted to various kinds of fluid as claimed in claim 4, wherein a plurality of horizontal notches are provided on the wide and flat end of the pin shaped core body adjacent the attachment face, and the end as well as the notches are roundly angled; or a plurality of convex points of any shape are provided on the wide and flat end.

7. A wide faced applicator adapted to various kinds of fluid as claimed in claim 1, wherein a flange is provided on the end face of the end stopper; said plurality of throttling holes including a cross shaped throttling hole on the center of the end face of the end stopper and a plurality of throttling holes each disposed on a quarter of a circle on the peripheral edge and the inner end face of the flange.

8. A wide faced applicator adapted to various kinds of fluid as claimed in claim 1, wherein a ball or a block in any proper shape is placed inside the inner diameter hole of the end stopper to effect the pumping operation.

9. A wide faced applicator adapted to various kinds of fluid as claimed in claim 1, wherein the liner of the cover is integrally molded with the same material of the cover.

10. A wide faced applicator adapted to various kinds of fluid as claimed in claim 1, wherein a longitudinally curved dent slot is formed on an upper end face of the cover, while a scraper made of a plurality of flexible sheets adjacent to one another is provided inside the dent slot.

11. A wide faced applicator adapted to various kinds of fluid as claimed in claim 10, wherein a notch is provided individually in the middle of the scraper.

12. A wide faced applicator adapted to various kinds of fluid as claimed in claim 11, wherein the scraper is integrally molded with the same material of the cover.

13. A wide faced applicator adapted to various kinds of fluid as claimed in claim 1, wherein an upper end of the cover forms a transparent hood.

14. A wide faced applicator adapted to various kinds of fluid as claimed in claim 13, wherein a dent slot is formed on one side inside the cover; a scraper made of a plurality of flexible sheets is provided in the dent slot, a notch is provided in the middle of the scraper; and the scraper may be integrally formed with the cover, or formed as a separate element to engage with the cover.

15. A wide faced applicator adapted to various kinds of fluid as claimed in claim 13, wherein a dent slot is formed on one side inside the cover, and a plurality of recesses which do not penetrate the wall thickness are provided on the dent slot, whereby the wall thickness between recesses forms a plurality of scrapers.

16. A wide faced applicator adapted to various kinds of fluid as claimed in claim 1, wherein the cover is not resilient, and a dent slot is formed on one of the flange portions which is disposed in the front axis portion of the main body to obtain flexibility so that the cover and the main body may engage with each other resiliently and tightly.

17. A wide faced applicator adapted to various kinds of fluid as claimed in claim 1, wherein balls of any size or blocks of any shape, singular or plural, are placed in the container tank to stir up uniformly the fluid in the container tank.

18. A wide faced applicator adapted to various kinds of fluid as claimed in claim 1, wherein the fluid fully filled in the container tank is correction liquid, or ink, or adhesive, or paint, or wax.

19. A wide faced applicator adapted to various kinds of fluid as claimed in claim 1, wherein the main body and the seat are integrally formed.

20. A wide faced applicator adapted to various kinds of fluid as claimed in claim 19, wherein the front axis portion of the main body is of the insertion type, an engaging recess is provided on a peripheral edge of an axial end of the front axis portion, and a flange is provided on a front end of the engaging recess, the funnel shaped hole is disposed to match with the configuration of the axial end of the front axis portion so as to engage with a flange provided on an inner edge of the funnel shaped hole; and a positioning slot is provided on the flange on the front end of the engaging recess, and a tenon matching with the positioning slot is provided on an inner edge of the funnel shaped hole in the front axis portion of the main body whereby both the tenon and the positioning slot engage with each other in a proper limited angle.

21. A wide faced applicator adapted to various kinds of fluid as claimed in claim 20 wherein the flat cut face has an end segment thereof which is a gradually reduced plane curved face reserving a plane segment on the attachment face, thus constituting the wide narrow sided attachment face with rounded angles at the crossed corners at the opposite sides of the wide attachment face.

22. A wide faced applicator adapted to various kinds of fluid as claimed in claim 21, wherein the attachment face of the front axis portion is a flat mouth perpendicular to the axis.

23. A wide faced applicator adapted to various kinds of fluid as claimed in claim 22, wherein each side of the narrow attachment face of the front axis portion is provided with a circular shrinkage and deformation prevention hole parallel to the attachment face.

24. A wide faced applicator adapted to various kinds of fluid as claimed in claim 22, wherein each side of the front axis portion is provided with a longitudinal long slot hole serving as a shrinkage and deformation prevention hole parallel to the funnel shaped hole and the attachment face.

25. A wide faced applicator adapted to various kinds of fluid as claimed in claim 22, wherein each side of the narrow attachment face is provided with a longitudinal long slot hole formed as a shrinkage and deformation prevention hole parallel to the funnel shaped hole and the attachment face.

26. A wide faced applicator adapted to various kinds of fluid as claimed in claim 22, wherein the funnel shaped hole at the attachment face gradually enlarges toward the end stopper.

27. A wide faced applicator adapted to various kinds of fluid as claimed in claim 22, wherein the shape of the guiding holes on the wide attachment face is parallel to the attachment face to form a rectangle, or a curved opening, the width of which gradually enlarges toward the end stopper.

28. A wide faced applicator adapted to various kinds of fluid as claimed in claim 22, wherein the the guiding holes are provided on one side but the total width is less than or equal to the axial width of the end of the pin shaped core body adjacent the attachment face.

29. A wide faced applicator adapted to various kinds of fluid as claimed in claim 28, wherein the guiding holes are provided on one side in an applying direction having a curved face toward the attachment face reserving a configuration of a plane segment.

30. A wide faced applicator adapted to various kinds of fluid as claimed in claim 22, wherein the guiding holes are provided on both sides of the attachment face, and the total width is less than or equal to the axial width of the end of the pin shaped core body adjacent the attachment face.

31. A wide faced applicator adapted to various kinds of fluid as claimed in claim 30, wherein the guiding holes are formed with a face curved towards the attachment face reserving a plane segment configuration.

32. A wide faced applicator adapted to various kinds of fluid as claimed in claim 21, wherein the attachment face of the front axis portion is an oblique mouth to form an oblique angle with the axis.

33. A wide faced applicator adapted to various kinds of fluid as claimed in claim 20, wherein the front axis portion is metal and is cut to shape.

34. A wide faced applicator adapted to various kinds of fluid as claimed in claim 20, wherein the end stopper and the axial end of the main body are integrally formed.

35. A wide faced applicator adapted to various kinds of fluid as claimed in claim 34, wherein the plurality of throttling holes includes a cross shaped throttling hole provided on the center of the end face of the end stopper a plurality of circular throttling holes peripheral on the edge of the end face of the end stopper extending perpendicularly downward along the axial extent of the pin shaped core body to form double way throttling holes; and the plurality of the circular throttling holes being configured such that each hole is elongated to define an entrance end spaced apart from an exit end with the exit end being smaller in diameter than the entrance end and being gradually enlarged toward the entrance end.

36. A wide faced applicator adapted to various kinds of fluid as claimed in claim 34, wherein the plurality of throttling holes includes a cross shaped throttling hole provided on the end face of the end stopper to form a single way throttling hole.

37. A wide faced applicator adapted to various kinds of fluid as claimed in claim 34, wherein the plurality of throttlings holes includes a plurality of circular throttling holes provided on the peripheral edge of the end face of the end stopper extending perpendicularly downward along the axial extent of the pin shaped core body and a plurality of circular throttling holes provided on the side wall of the end stopper adjacent the end face through the wall thickness to form a 90° angle with the funnel shaped hole, thus forming double way throttling holes; the circular throttling holes being configured such that each hole is elongated to define a passageway having an entrance end spaced apart from an exit end with the exit end being smaller in diameter than the entrance end, and the passageway is gradually enlarged from the exit and towards the entrance end.

38. A wide faced applicator adapted to various kinds of fluid as claimed in claim 34, wherein a plurality of throttling holes are provided on the side wall of the end stopper adjacent the end face, passing through the wall thickness and forming a 90° angle with the funnel shaped hole to form single way throttling holes.

* * * * *